US009020385B2

(12) United States Patent
Kajita et al.

(10) Patent No.: US 9,020,385 B2
(45) Date of Patent: Apr. 28, 2015

(54) IMAGE FORMING APPARATUS WHICH CONTROLS FIXING DRIVE MOTOR ACCORDING TO PRESSURE ROLLER DIAMETER

(71) Applicant: Brother Kogyo Kabushiki Kaisha, Nagoya-shi, Aichi-ken (JP)

(72) Inventors: Masahito Kajita, Nagoya (JP); Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/189,437

(22) Filed: Feb. 25, 2014

(65) Prior Publication Data

US 2014/0241746 A1 Aug. 28, 2014

(30) Foreign Application Priority Data

Feb. 25, 2013 (JP) ..... 2013-034277

(51) Int. Cl.
*G03G 15/20* (2006.01)

(52) U.S. Cl.
CPC ..... *G03G 15/206* (2013.01); *G03G 2215/0141* (2013.01); *G03G 2215/2045* (2013.01)

(58) Field of Classification Search
CPC ..... G03G 15/657; G03G 15/2064; G03G 2215/00413; G03G 2215/00679; G03G 2215/2045; G03G 15/206; G03G 2215/0141
USPC ..... 399/33, 67, 68, 320, 328, 331; 219/216
See application file for complete search history.

(56) References Cited

U.S. PATENT DOCUMENTS 5,819,149 A * 10/1998 Watanabe et al. ..... 399/330
7,941,063 B2 * 5/2011 Suzuki et al. ..... 399/44

FOREIGN PATENT DOCUMENTS

| | | | |
|---|---|---|---|
| JP | 02082280 A | * | 3/1990 |
| JP | 06043783 A | * | 2/1994 |
| JP | 10207154 A | * | 8/1998 |
| JP | 2002-351241 A | | 12/2002 |
| JP | 2002351241 A | * | 12/2002 |
| JP | 2002365959 A | * | 12/2002 |
| JP | 2006138942 A | * | 6/2006 |
| JP | 2008003297 A | * | 1/2008 |

* cited by examiner

*Primary Examiner* — Robert Beatty
(74) *Attorney, Agent, or Firm* — Banner & Witcoff, Ltd.

(57) ABSTRACT

An image forming apparatus includes a fixing device, a motor, and a control device. The fixing device includes a heating member, a drive roller in contact with the heating member at a nip portion therebetween, and a memory configured to store an outer diameter of the drive roller. The motor is configured to drive the drive roller. The control device is configured to read the outer diameter from the memory, adjust a rotation speed of the motor such that the rotation speed of the motor becomes smaller as the outer diameter read from the memory becomes larger, and drive the motor at an adjusted rotation speed.

12 Claims, 9 Drawing Sheets

IMAGE FORMING APPARATUS WHICH CONTROLS FIXING DRIVE MOTOR ACCORDING TO PRESSURE ROLLER DIAMETER

CROSS REFERENCE TO RELATED APPLICATION

This application claims priority from Japanese Patent Application No. 2013-034277 filed Feb. 25, 2013. The entire content of this priority application is incorporated herein by reference.

TECHNICAL FIELD

The present invention relates to an image forming apparatus including a fixing device having a drive roller that forms a nip portion between a heating member and the drive roller.

BACKGROUND

Conventionally, an image forming apparatus disclosed in Japanese Patent Application Publication No. 2002-351241 is provided with a motor, a fixing device including an endless belt, a nip plate disposed within the belt, and a pressure roller for nipping the belt in cooperation with the nip plate to form a nip portion therebetween. Upon inputting drive force to the pressure roller, the belt rotates following the rotation of the pressure roller.

SUMMARY

The image forming apparatus further includes a memory storing an outer diameter of the pressure roller which is measured at manufacturing time of the image forming apparatus. The motor is adapted to drive the pressure roller and controlled based on the outer diameter. However, in the above conventional configuration, since the memory is provided in the body of the image forming apparatus, when the fixing device is replaced with new one, an outer diameter of the new fixing device is different from the outer diameter stored in the memory provided in the body of the image forming apparatus, which may prevent adequate control of the motor.

It is an object of the present invention to provide an image forming apparatus capable of adequately controlling the motor in accordance with the outer diameter of the pressure roller (drive roller) even when the fixing device is replaced with new one.

In view of the foregoing, it is an object of the invention to provide an image forming apparatus. The image forming apparatus includes a fixing device, a motor, and a control device. The fixing device includes a heating member, a drive roller in contact with the heating member at a nip portion therebetween, and a memory configured to store an outer diameter of the drive roller. The motor is configured to drive the drive roller. The control device is configured to read the outer diameter from the memory, adjust a rotation speed of the motor such that the rotation speed of the motor becomes smaller as the outer diameter read from the memory becomes larger, and drive the motor at an adjusted rotation speed.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
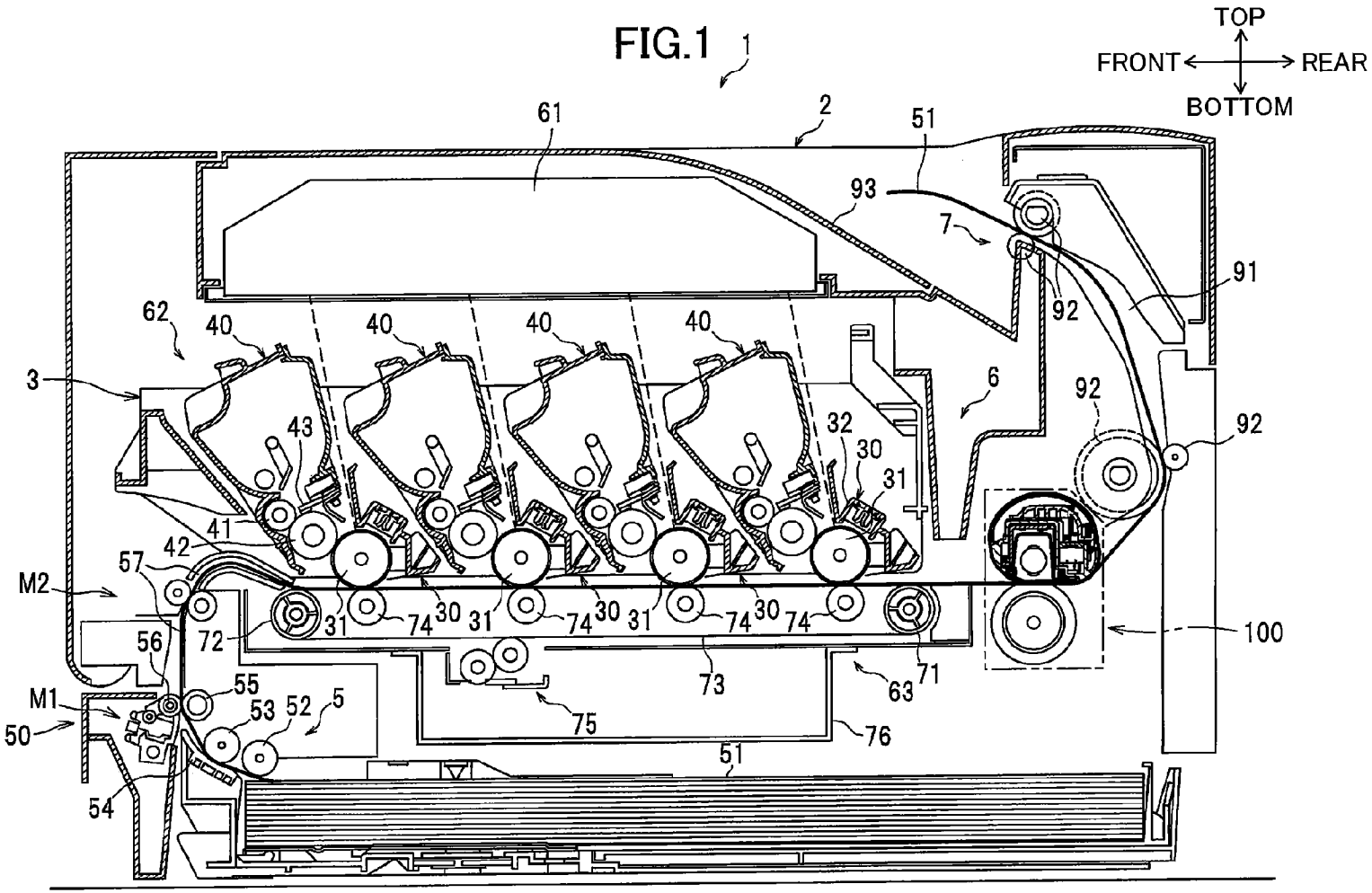
FIG. 1 is a cross-sectional view of a color laser printer according to illustrative aspects of the invention.

An embodiment of the present invention will be described while referring to the drawings. Hereinafter, unless otherwise specified, a top-bottom direction illustrated in FIG. 1 is referred to as a top-bottom direction, a left side illustrated in FIG. 1 as "front", a right side as "rear", a far side to as "left", and a near side to as "right". The left and right sides of the color laser printer 1 as an example of an image forming apparatus are based on the perspective view of a user viewing the color laser printer 1 from the front.

As illustrated in FIG. 1, the color laser printer 1 includes, a printer body 2, a sheet supply section 5 adapted to supply a sheet 51, an image forming section 6 adapted to form an image on the supplied sheet 51, and a sheet discharge section 7 adapted to discharge the sheet 51 on which the image has been formed. Each component is provided in the printer body 2.

The sheet supply section 5 is provided in a lower portion of the printer body 2 and includes a sheet cassette 50 attached to and detached from the printer body 2 in a sliding manner from the front side and a sheet supply mechanism M1 that lifts a front side of the sheet 51 stored in the sheet cassette 50 and then conveys the sheet 51 in an inverted manner to the rear side.

The sheet supply mechanism M1 includes a pickup roller 52, a separating roller 53, and a separating pad 54, which are provided at a front end portion of the sheet cassette 50 to separate the sheet 51 one sheet at a time and feed the sheet 51 upward. The sheet 51 conveyed upward is subjected to the removal of paper dust while passing between a paper dust removal roller 55 and a pinch roller 56, turns its direction to the rear side along a conveying path 57, and then is supplied onto a conveying belt 73.

The image forming section 6 includes a scanner unit 61, a process unit 62, a transfer unit 63, and a fixing device 100.

The scanner unit 61 is provided at an upper portion of the printer body 2 and includes a laser emitting unit, a polygon mirror, a plurality of lenses, and a reflecting mirror (not shown). The laser emitting section emits laser beams corresponding to four colors of cyan, magenta, yellow, and black, in the scanner unit 61 and the polygon mirror scans the laser beams at high speed in the left-right direction. The laser beams then pass through or are reflected by the lenses and reflecting mirror and is irradiated on each of a plurality of photosensitive drums 31.

The process unit 62 is disposed below the scanner unit 61 and above the sheet supply section 5 and includes a photosensitive unit 3, four drum sub-units 30, and developing cartridges 40. The photosensitive unit 3 is provided so as to be drawable from the printer body 2 in the front-rear direction. The four drum sub-units 30 are provided below the photosensitive unit 3. The developing cartridges 40 are detachably attached to the four drum sub-units 30, respectively.

Each of the drum sub-units 30 includes a photosensitive drum 31 and a scorotron charger 32. The developing cartridge 40 accommodates therein toner and includes a supply roller 41, a developing roller 42, and a layer thickness regulating blade 43.

The process unit 62 having the above configuration functions as follows. The toner accommodated in the developing cartridge 40 is supplied to the developing roller 42 by the supply roller 41. At this time, the toner is positively friction-charged between the supply roller 41 and the developing roller 42. The toner supplied to the developing roller 42 is regulated by the layer thickness regulating blade 43 and is thus carried on a surface of the developing roller 42 as a uniform thin layer.

The scorotron charger 32 uniformly and positively charges the photosensitive drum 31 by corona discharge in the drum sub-unit 30. The charged photosensitive drum 31 is irradiated with the laser beam from the scanner unit 61, and thereby an electrostatic latent image corresponding to an image to be formed on the sheet 51 is formed on the photosensitive drum 31.

As the photosensitive drum 31 further rotates, the toner carried on the developing roller 42 is supplied to the electrostatic latent image formed on the photosensitive drum 31, i.e., a part of the uniformly positively charged surface of the photosensitive drum 31 at which potential is lowered by the exposure to the laser beam. Thus, the electrostatic latent image on the photosensitive drum 31 is developed into a toner image produced by reverse development in correspondence with each of the four colors carried on the surface of each of the photosensitive drums 31.

The transfer unit 63 includes a drive roller 71, a driven roller 72, a conveying belt 73, transfer rollers 74, and a cleaning unit 75. The drive roller 71 and driven roller 72 are disposed in parallel and spaced apart from each other in the front-rear direction, and the endless conveying belt 73 is wound therebetween. The conveying belt 73 has an outer surface in contact with each photosensitive drum 31. Each transfer roller 74 and each corresponding photosensitive drum 31 sandwich the conveying belt 73 therebetween inside the conveying belt 73. The transfer rollers 74 are applied with a transfer bias from a high-voltage substrate (not shown). At time of image formation, the sheet 51 conveyed by the conveying belt 73 is held between the photosensitive drum 31 and the transfer roller 74, and the toner image on the photosensitive drum 31 is transferred onto the sheet 51.

The cleaning unit 75 is disposed below the conveying belt 73 and adapted to collect the toner adhered to the conveying belt 73 and to drop the removed toner into a toner reservoir 76 disposed below the cleaning unit 75.

The fixing device 100 is provided rearward of the transfer unit 63 and adapted to thermally fix the toner image transferred onto the sheet 51. Detail configurations of the fixing device 100 will be described later.

In the sheet discharge section 7, a discharge-side conveying path 91 of the sheet 51 is formed so as to extend upward from an exit of the fixing device 100 and then to be turned forward. A plurality of conveying rollers 92 for conveying the sheet 51 are disposed in the middle of the discharge-side conveying path 91. A sheet discharge tray 93 for storing the sheets 51 after printing is formed on an upper surface of the printer body 2. The sheet 51 discharged from the discharge-side conveying path 91 by the conveying rollers 92 is accumulated in the sheet discharge tray 93.

In the present embodiment, a conveying mechanism M2 for conveying the sheet 51 is configured of the above-described sheet supply mechanism M1, the photosensitive drums 31, the conveying belt 73, a pressure roller 140 to be described later, the conveying rollers 92, and a motor 500 (see FIG. 2) to be described later.

Figure 2A:
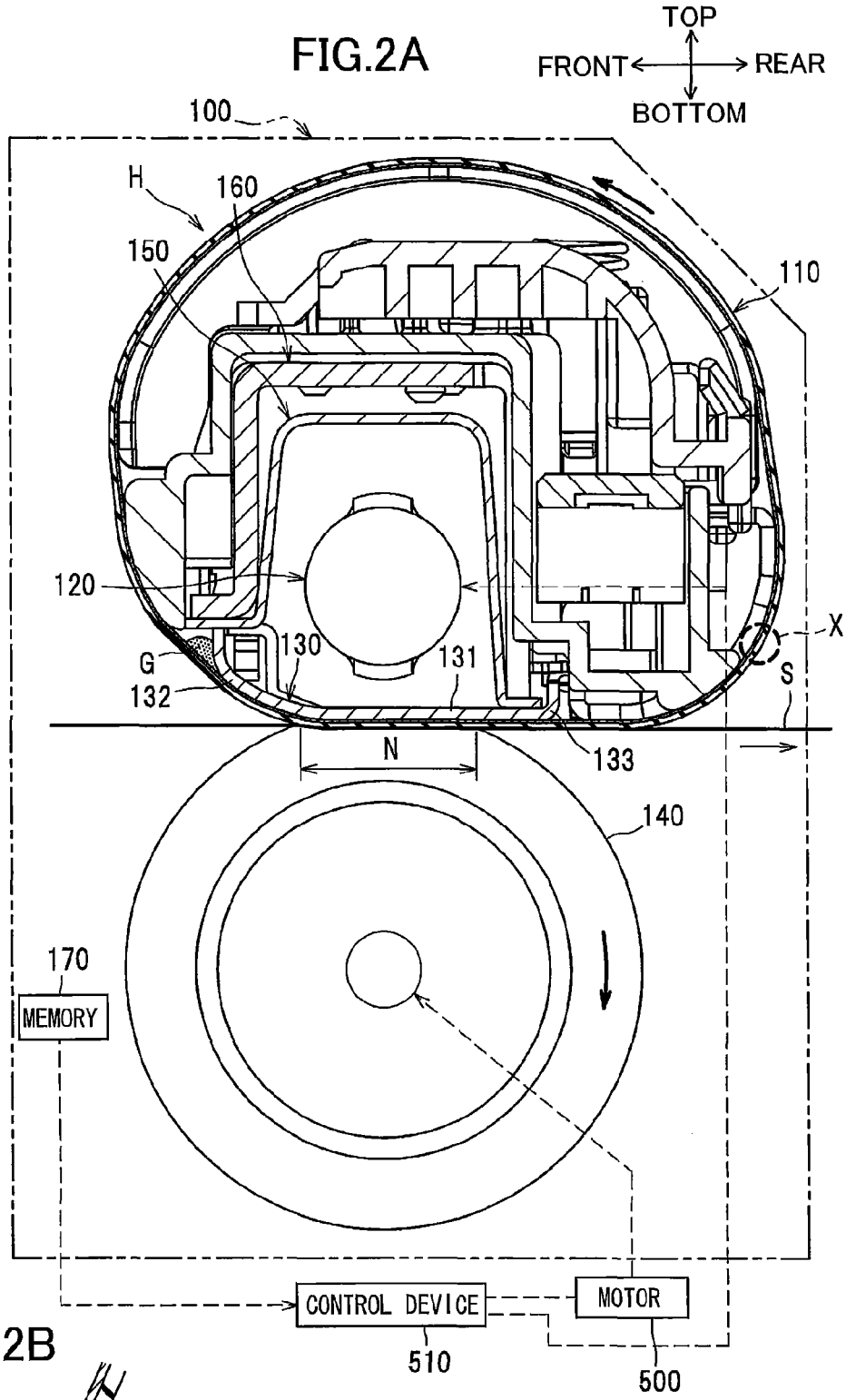
FIG. 2A is a partial enlarged view of a fixing device and a control device.

As illustrated in FIG. 2A, the fixing device 100 includes a heating member H, a pressure roller 140 as an example of a drive roller, and a memory 170. The heating member H includes a fusing belt 110, a halogen lamp 120, a nap plate 130, a reflecting plate 150, and a stay 160.

Figure 2B:
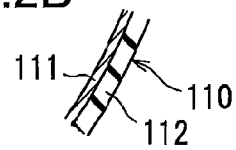
FIG. 2B is a partial enlarged view of a region X in FIG. 2A.

The fusing belt 110 is an endless (tubular) belt having heat resistance and flexibility. As illustrated in FIG. 2B, the fusing belt 110 has an element tube 111 formed of a stainless steel and a rubber layer 112 formed on an outer surface of the element tube 111. The halogen lamp 120, the nip plate 130, the reflecting plate 150, and the stay 160 are provided inside the fusing belt 110.

The halogen lamp 120 generates radiant heat for heating the nip plate 130 and the fusing belt 110 (a nip portion N) to heat the toner on the sheet 51. The halogen lamp 120 is disposed apart from an inner surface of the nip plate 130 at a predetermined distance.

The nip plate 130 is a plate-like member adapted to receive the radiant heat from the halogen lamp 120. The nip plate 130 is disposed such that a lower surface thereof sliding contacts an inner peripheral surface of the fusing belt 110. In the present embodiment, the nip plate 130 is formed of a metallic material. For example, the nip plate 130 is formed by bending an aluminum plate having heat conductivity higher than that of the stay 160 to be described later formed of steel. The nip plate 130 formed of aluminum is capable of enhancing its heat conductivity.

Figure 3:
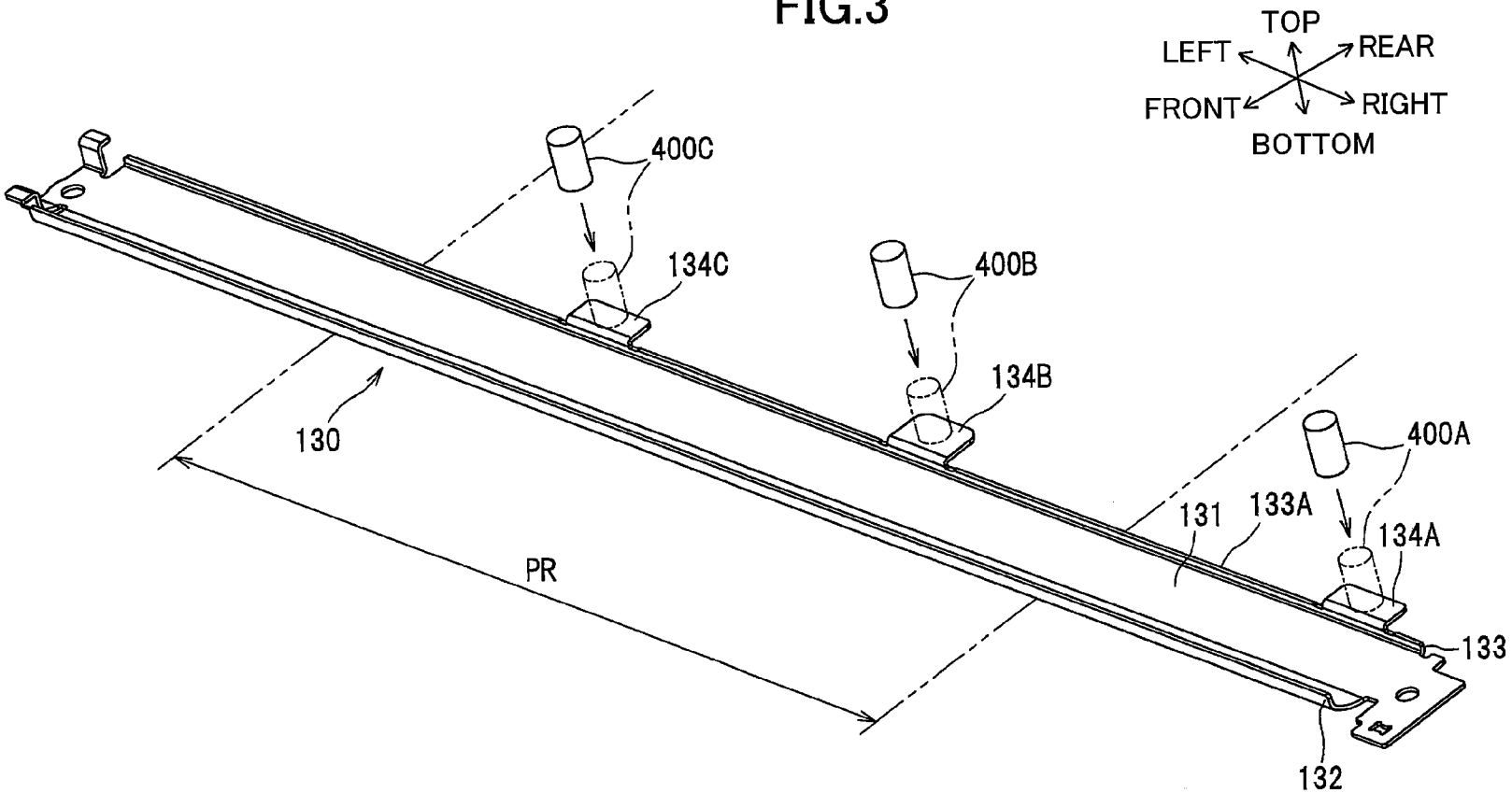
FIG. 3 is a schematic perspective view of a nip plate and each temperature sensor.

As illustrated in FIGS. 2 and 3, the nip plate 130 includes a plate portion 131, a front bent portion 132, a rear bent portion 133, and three detected portions 134A, 134B, and 134C.

The plate portion 131 is a plate-like member elongated in the left-right direction and disposed perpendicular to the up-down direction. The plate portion 131 and the pressure roller 140 sandwich the fusing belt 110 therebetween in the top-bottom direction to form a nip portion N between the pressure roller 140 and the fusing belt 110. The plate portion 131 is disposed below the halogen lamp 120 so as to transmit heat from the halogen lamp 120 to the toner on the sheet 51 through the fusing belt 110.

The front bent portion 132 is formed so as to be bent upward from the front end edge of the plate portion 131 in substantially a circular arc and is disposed opposite to the halogen lamp 120. The rear bent portion 133 is formed so as to extend upward from the rear end edge of the plate portion 131. More specifically, the rear bent portion 133 is formed so as to extend from one lateral end to the other lateral end of the rear end edge of the plate portion 131 in the left-right direction. The rear bent portion 133 has an upper end edge 133A at the upper end thereof.

The three detected portions 134A, 134B, and 134C are portions whose temperatures are detected by a side thermistor 400A, a thermostat 400B, and a center thermistor 400C, respectively. The three detected portions 134A, 134B, and 134C are formed so as to extend rearward from a part of the upper end edge 133A. More specifically, two detected portions 134B and 134C are disposed at substantially a center portion of the rear bent portion 133 in the left-right direction, and one detected portion 134A is disposed at the one lateral end of the rear bent portion 133 in the left-right direction.

The detected portions 134B and 134C are disposed within a minimum sheet passage range PR in the left-right direction, and the detected portion 134A is disposed outside the minimum sheet passage range PR in the left-right direction. Here, the minimum sheet passage range PR indicates a passage range of a sheet having the minimum width in the left-right direction, among the sheets that can be used in the color laser printer 1.

The side thermistor 400A and the center thermistor 400C are temperature detectors for transmitting detected temperatures to a control device 510 and detect the temperatures of the detected portions 134A and 134C to indirectly detect a temperature of the nip portion N. The thermostat 400B is a thermal switch for mechanically interrupting electricity to the halogen lamp 120 when a detected temperature exceeds a predetermined temperature.

The side thermistor 400A may be a contact type thermistor that directly contacts the detected portion 134A so as to detect the temperature of the detected portion 134A, or may be a non-contact type thermistor that detects the temperature of the detected portion 134A without contacting the detected portion 134A. Similarly, the center thermistor 400C may be a contact type thermistor that directly contacts the detected portion 134C so as to detect the temperature of the detected portion 134C, or may be a non-contact type thermistor that detects the temperature of the detected portion 134C without contacting the detected portion 134C.

As illustrated in FIG. 2, the pressure roller 140 is disposed below the nip plate 130 and sandwiches the fusing belt 110 between the nip plate 130 and the same, thereby forming the nip portion N therebetween. Further one of the nip plate 130 and the pressure roller 140 is biased toward the other in order to form the nip portion N. Further, the pressure roller 140 is configured to rotate by a driving force transmitted from a motor 500 provided inside the printer body 2, and configured to rotate together with the fusing belt 110 in a state where the fusing belt 110 and the sheet 51 are sandwiched between the pressure roller 140 and the nip plate 130, thereby conveying the sheet 51 rearward.

The reflecting plate 150 is adapted to reflect the radiant heat from the halogen lamp 120 toward the nip plate 130 and is disposed inside the fusing belt 110 so as to surround the halogen lamp 120 with predetermined gaps from the halogen lamp 120. The reflecting plate 150 is formed by bending, for example, an aluminum plate having high reflectivity for infrared rays and far infrared rays, in a U-like shape in cross-section.

The stay 160 is a member that supports the nip plate 130 through the reflecting plate 150 to receive a pressure from the pressure roller 140. The stay 160 is disposed so as to surround the halogen lamp 120 and the reflecting plate 150 inside the fusing belt 110. Here, the stay 160 receives a reaction force of the force at which the nip plate 130 biases the pressure roller 140 while the nip plate 130 biases the pressure roller 140. The stay 160 is formed by bending a material having relatively high rigidity, for example, a steel plate.

The halogen lamp 120 and the motor 500 for driving the pressure roller 140 are controlled by the control device 510. The motor 500 is configured not only to supply driving force to the pressure roller 140 through a gear mechanism not illustrated but also to supply driving force to the supply roller 41 and the developing roller 42.

The memory 170 stores an outer diameter of the pressure roller 140, a heating capability of the halogen lamp 120, a width of the nip portion N, a responsiveness of the center thermistor 400C, and a thickness of the rubber layer 112, which are previously measured under reference conditions. The heating capability refers to an amount of heat generation per unit time.

The outer diameter of the pressure roller 140 may be measured by, e.g., a laser displacement meter. The heating capability of the halogen lamp 120 may be obtained by actually measuring temperature gradient of the nip portion N using a thermocouple.

The width of the nip portion N may be obtained by heating for a certain time a sheet printed in solid black nipped between the pressure roller 140 and the fusing belt 110 and measuring a range different in gloss from the other portion of the sheet with a scale. The responsiveness of the center thermistor 400C may be obtained by measuring a time required for a temperature detected by the center thermistor 400C to reach a second temperature higher than the first temperature while increasing the temperature of the nip portion N under a predetermined first temperature environment. The thickness of the rubber layer 112 may be obtained by measuring a total thickness of the fusing belt 110 with a micrometer and subtracting a previously measured thickness of the element tube 111 from the total thickness.

The following correction expression is stored in the memory 170 in order to adjust a rotation speed of the motor 500.

$$N=N_0+f_0(t)-\alpha\times(D-D_0)-\beta(t)\times(W-W_0)-\gamma(t)\times(B-B_0)-\delta\times f_0''(t)+\epsilon(t)\times(d-d_0)$$

Figure 4A:
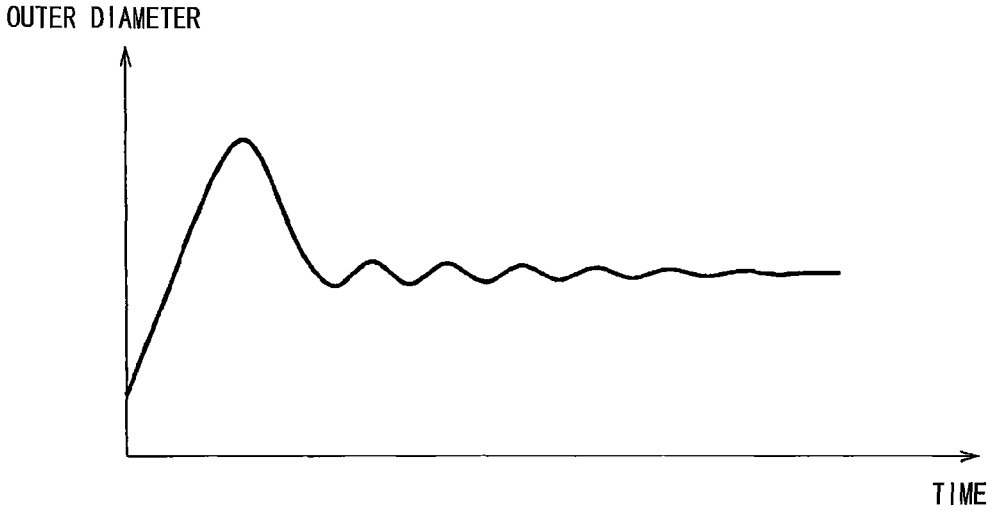
FIG. 4A is a graph illustrating an outer diameter change of a pressure roller in a continuous printing.
Figure 4B:
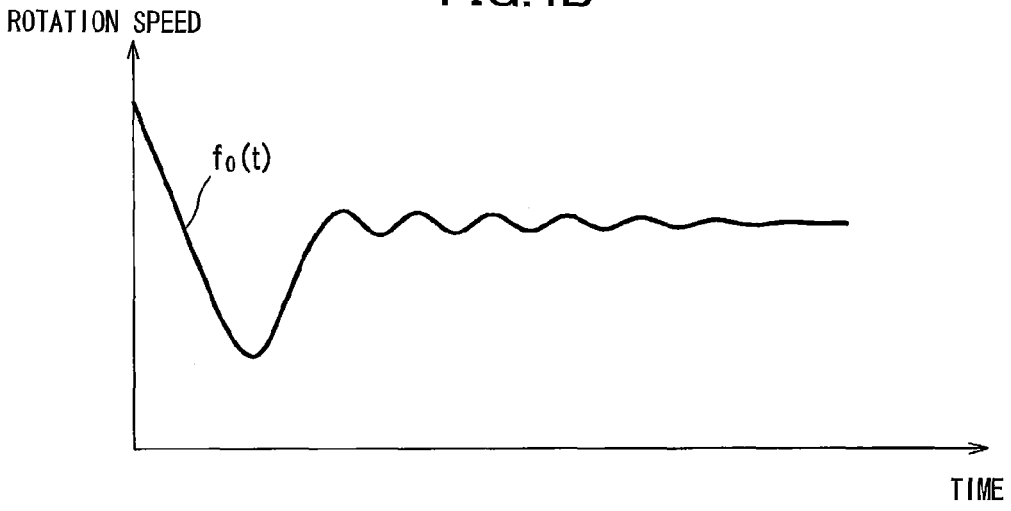
FIG. 4B is a graph illustrating a function $f_0(t)$ for maintaining a conveying speed of a sheet which is varied depending on the outer diameter change of the pressure roller.

"No" stands for a reference rotation speed of the motor 500 in the above correction expression. Further "$f_0(t)$" stands for a function of time t serving as a basic function for correcting the rotation speed of the motor 500 so that a conveying speed of the sheet 51 is maintained constant even if the outer diameter of the pressure roller 140 changes with time t in the above correction expression. More specifically, when a plurality of the sheets 51 are continuously printed under a low-temperature environment, the outer diameter of the pressure roller 140 changes with time according to a waveform as illustrated in FIG. 4A. The function $f_0(t)$ having a waveform as illustrated in FIG. 4B is obtained by inverting the waveform representing a change of the outer diameter in the continuous printing (FIG. 4A). When the continuous printing is performed, the function $f_0(t)$ is set to cancel the outer diameter change of the pressure roller 140. The waveform representing the outer diameter change of the pressure roller 140 can be obtained by experiments or simulations, so that the function $f_0(t)$ can be set based on the obtained waveform.

Further, when print jobs for printing a predetermined number of sheets are performed intermittently more than once in a intermittent printing or when a temperature environment upon reception of a print command is medium or high temperature, a waveform of the outer diameter change differs from each condition (for each print job or for each temperature). Thus, the waveform for each condition is previously obtained by experiments or the like, and a basic function is set for the obtained waveform. That is, a plurality of functions that cancels the temporal change of the outer diameter of the pressure roller 140 is stored in the memory 170 according to various conditions.

The term "$-\alpha\times(D-D_0)$" is a first correction term for canceling the influence on the conveying speed of the sheet 51 due to a manufacturing error of the pressure roller 140. "D" stands for a previously measured outer diameter of the pressure roller 140, "$D_0$" stands for a reference outer diameter of the pressure roller 140, and "a" stands for a coefficient representing contribution of an outer diameter error in the first correction term.

Figure 5A:
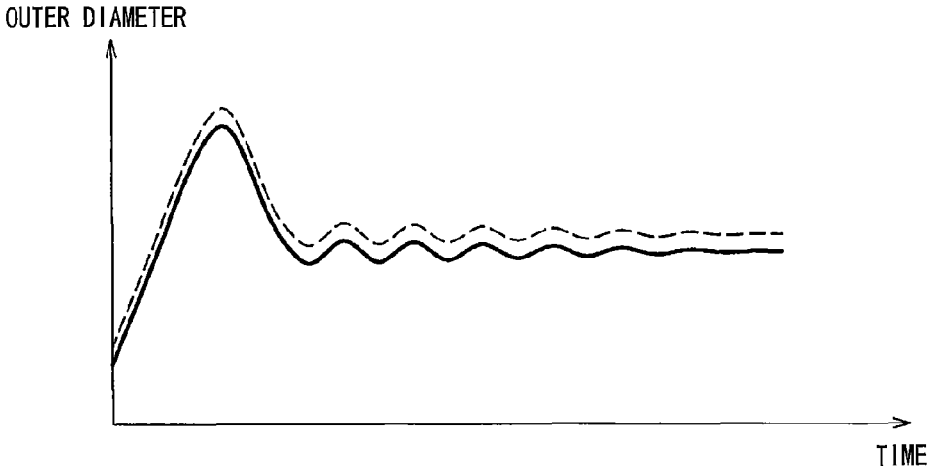
FIG. 5A is a graph illustrating an outer diameter change of the pressure roller when an outer diameter of the pressure roller is larger than a reference outer diameter.
Figure 5B:
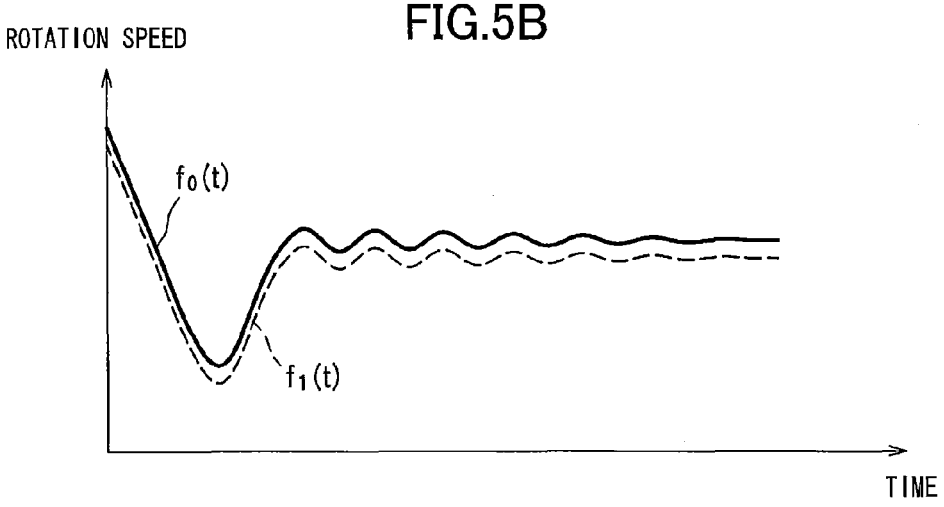
FIG. 5B is a graph illustrating a function $f_1(t)$.

Specifically, as illustrated in FIG. 5A, when the outer diameter D larger than the reference outer diameter $D_0$ changes with time, the outer diameter change is represented as indicated by a dotted line in a waveform obtained by shifting upward a waveform of the reference outer diameter $D_0$ as indicated by solid line. Thus, as illustrated in FIG. 5B, a function $f_1(t)$ making the conveying speed constant for such a large outer diameter D is represented as indicated by a dotted line in a waveform obtained by shifting downward the basic function $f_0(t)$ corresponding to the reference outer diameter $D_0$ as indicated by a solid line, that is, $f_0(t)-\alpha\times(D-D_0)$.

Thus, the first correction term $-\alpha\times(D-D_0)$ for the outer diameter error is added to the above-described function $N=N_0+f_0(t)$, allowing the influence on the conveying speed due to the outer diameter error to be reduced. Specifically, the first correction term $-\alpha\times(D-D_0)$ is such a correction term that the rotation speed of the motor 500 becomes smaller as the outer diameter of the pressure roller 140, i.e., the previously measured outer diameter D, stored in the memory 170 becomes larger.

The term "$-\beta(t)\times(W-W_0)$" is a second correction term for canceling the influence on the conveying speed of the sheet 51 due to an error of the heating capability of the halogen lamp 120. "W" stands for a previously measured heating capability of the halogen lamp 120, "$W_0$" stands for a reference heating capability of the halogen lamp 120, and "$f_3(t)$" stands for a function of time t representing contribution of the heating capability error in the second correction term.

Figure 6A:
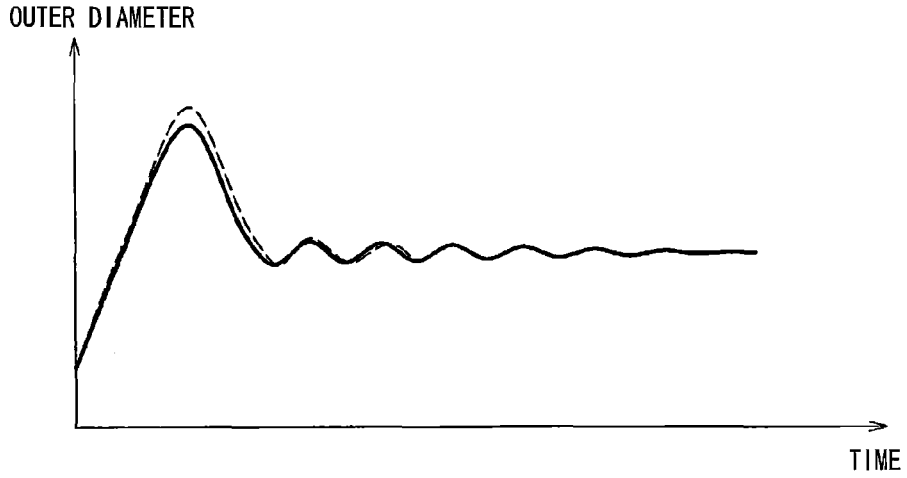
FIG. 6A is a graph illustrating an outer diameter change of the pressure roller when a heat capability of a halogen lamp is larger than a reference heating capability.
Figure 6B:
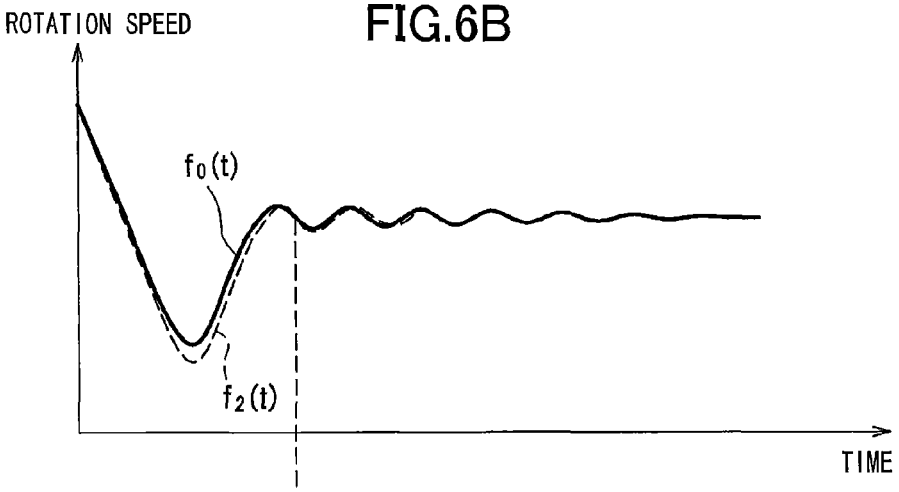
FIG. 6B is a graph illustrating a function $f_2(t)$.
Figure 6C:
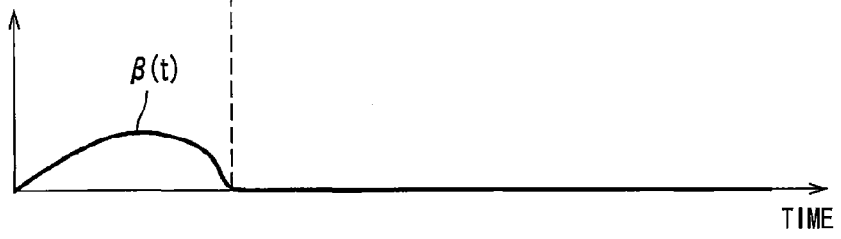
FIG. 6C is a graph illustrating a function $\beta(t)$.

Specifically, a solid line in FIG. 6A represents the outer diameter change when the pressure roller 140 is heated with the reference heating capability $W_0$, and a dotted line in FIG. 6A represents an outer diameter change when the pressure roller 140 is heated with the heating capability W higher than the reference heating capability $W_0$. In comparison with two curves, the outer diameter change represented by the dotted line (higher heating capability W) is noticeably changed in an early stage thereof relative to that represented by the solid line (reference heating capability $W_0$), and thereafter gradually becomes substantially the same as that represented by the solid line (reference heating capability $W_0$). Thus, as illustrated in FIG. 6B, a function $f_2(t)$ making the conveying speed constant for the heating capability W higher than the reference heating capability $W_0$ is represented by a waveform obtained by inverting the dotted waveform of FIG. 6A, i.e., $f_2(t)=f_0(t)-\beta(t)\times(W-W_0)$. Here, as illustrated in FIG. 6C, the function $f_3(t)$ is such a function that the influence of the heating capability error $(W-W_0)$ is cancelled only in the early stage of the outer diameter change, and specifically the influence of the correction is the largest at a peak value in the early stage of the outer diameter change.

Thus, the second correction term $-\beta(t)\times(W-W_0)$ for the heating capability error is added to the function $N=N_0+f_0(t)$, allowing the influence on the conveying speed due to the heating capability error to be reduced. More in detail, the second correction term $-\beta(t)\times(W-W_0)$ is such a correction term that the rotation speed of the motor 500 becomes smaller as the heating capability, i.e., the previously measured heating capability W, stored in the memory 170 becomes larger.

The term "$-\gamma(t)\times(B-B_0)$" is a third correction term for canceling the influence on the conveying speed due to an error of a width of the nip portion N in the lateral direction. "B" stands for a previously measured width of the nip portion N, "$B_0$" stands for a reference width of the nip portion N, and "$\gamma(t)$" stands for a function of time t representing contribution of the width error of the nip portion N in the third correction term.

The influence on the conveying speed due to the width error of the nip portion N can be considered in the same way as that due to the error of the heating capability. That is, the larger the width of the nip portion N, the larger an amount of heat to be transmitted from the nip portion N to the pressure roller 140, so that the width of the nip portion N can be considered the same as the heating capability of the halogen lamp 120. Thus, the outer diameter change due to the width error of the nip portion N is represented by a waveform similar to the waveform illustrated in FIG. 6A. Thus, similarly to the function $\beta(t)$ for the heating capability illustrated in FIG. 6C, the function $\gamma(t)$ that cancels the influence of the width error of the nip portion N should be set only in the early stage of the outer diameter change.

Thus, the third correction term $-\gamma(t)\times(B-B_0)$ for the width error of the nip portion N is added to the above-described function $N=N_0+f_0(t)$, allowing the influence on the conveying speed due to the width error of the nip portion N to be reduced. More in detail, the third correction term $-\gamma(t)\times(B-B_0)$ is such a correction term that the rotation speed of the motor 500 becomes smaller as the width of the nip portion N stored in the memory 170 becomes larger.

The term $-\delta\times f_0''(t)$ is a fourth correction term for canceling the influence on the conveying speed due to an error of the responsiveness of the center thermistor 400C. "$f_0''(t)$" stands for a function obtained by differentiating twice the basic function $f_0(t)$, and "$\delta$" stands for a function representing contribution of the fourth correction term corresponding to previously measured responsiveness of the center thermistor 400C. More specifically, the function "$\delta$" is such a function that the responsiveness becomes smaller as the contribution becomes higher.

Figure 7A:
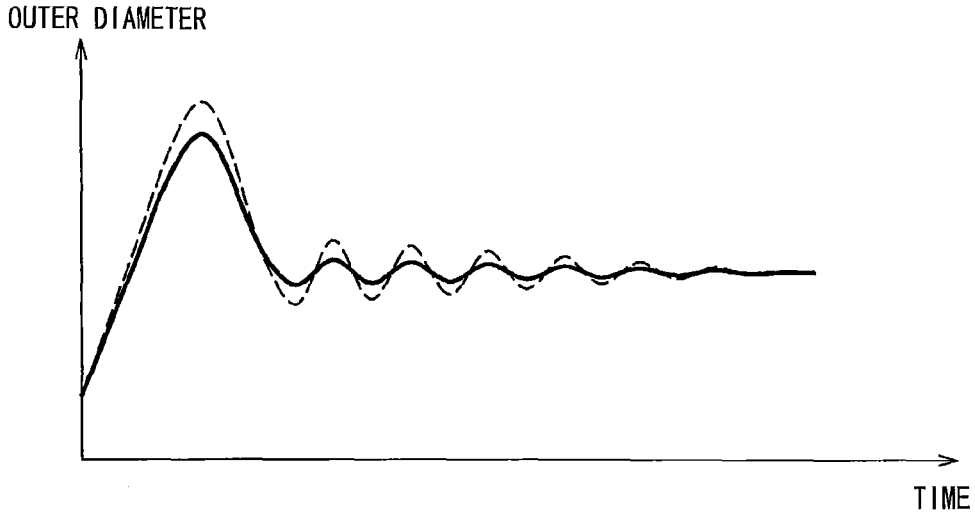
FIG. 7A is a graph illustrating an outer diameter change of the pressure roller when a responsiveness of a center thermistor is lower than a reference responsiveness.
Figure 7B:
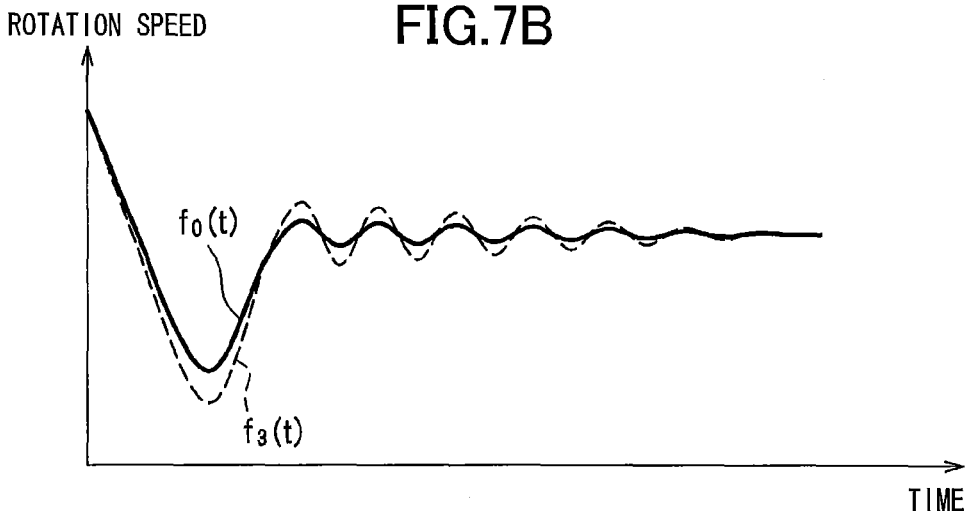
FIG. 7B is a graph illustrating a function $f_3(t)$.
Figure 7C:
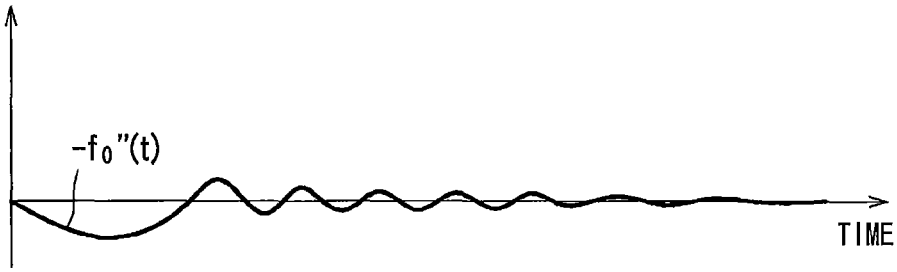
FIG. 7C is a graph illustrating a function $-f_0''(t)$.

Specifically, a solid line in FIG. 7A represents the outer diameter change when the responsiveness of the center thermistor 400C is a reference value, and a dotted line in FIG. 7A represents the outer diameter change when the responsiveness of the center thermistor 400C is lower than the reference value. In comparison with two curves, peak values of the outer diameter change represented by the dotted line (lower responsiveness) exceed ("overshoot") a reference value of the outer diameter change to positive or negative side in the outer diameter change represented by the solid line. Thus, a function $f_3(t)$ for making the conveying speed constant at the responsiveness lower than the reference responsiveness is represented by a waveform obtained by inverting the dotted waveform of FIG. 7A, i.e., $f_3(t)=f_0(t)-\delta\times f_0''(t)$. The change trend of the basic function $f_0(t)$ can be grasped by calculating the function $f_0''$ (t), as shown in FIG. 7C. The coefficient $\delta$ corresponding to the responsiveness is multiplied by the trend, i.e., the function $f_0''(t)$, thereby significantly correcting an overshoot amount, which becomes larger as the responsiveness is reduced, so as to be approximated to the function $f_0(t)$. That is, the fourth correction term $-\delta\times f_0''(t)$ is such a correction term that the overshoot of the outer diameter change of the pressure roller 140 is cancelled in accordance with the responsiveness stored in the memory 170.

The term "$+\epsilon(t)\times(d-d_0)$" is a fifth correction term for canceling the influence on the conveying speed due to an error of a thickness of the rubber layer 112. "d" stands for a previously measured thickness of the rubber roller, "$d_0$" stands for a reference thickness of the rubber layer 112, and "$\epsilon(t)$" stands for a function of time t representing contribution of the thickness error of the rubber layer 112 in the fifth correction term.

Figure 8A:
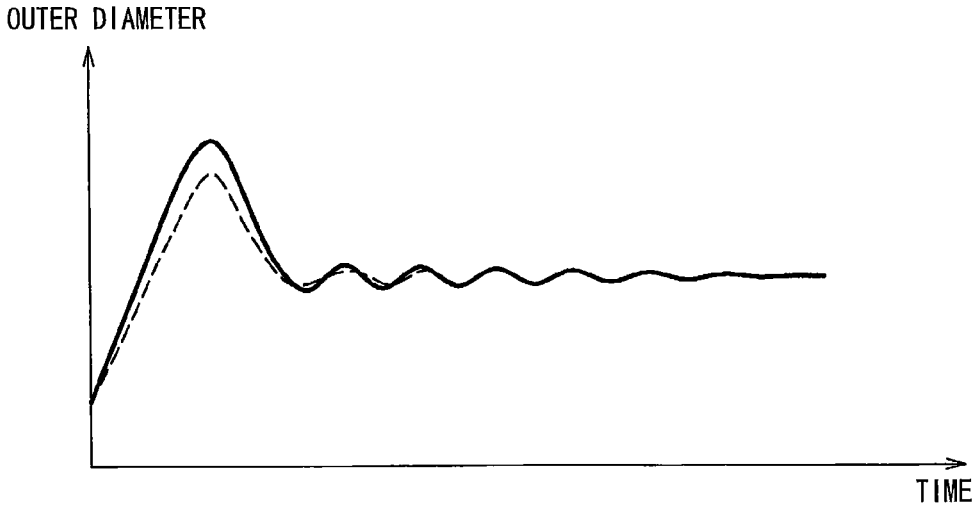
FIG. 8A is a graph illustrating an outer diameter change of the pressure roller when a thickness of a rubber layer is larger than a reference thickness.
Figure 8B:
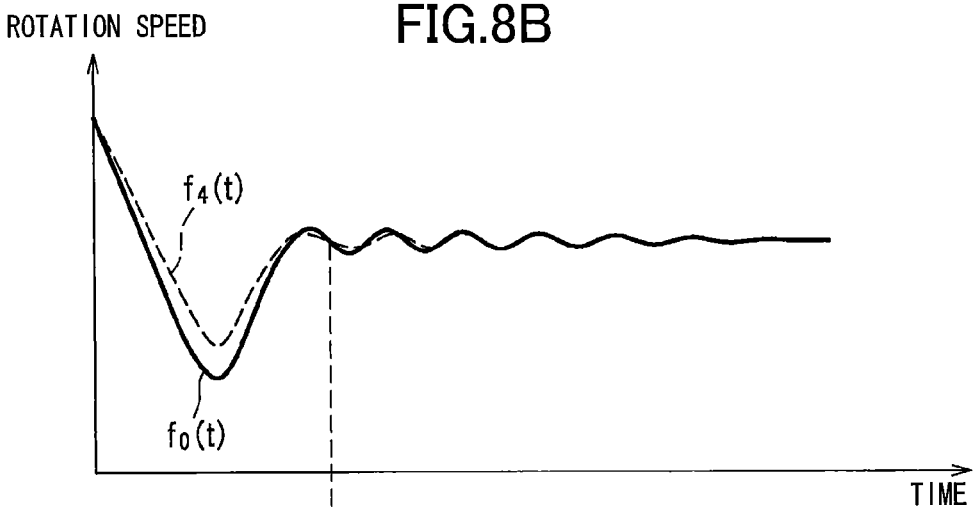
FIG. 8B is a graph illustrating a function $f_4(t)$.

Specifically, a solid line in FIG. 8A represents the outer diameter change when the thickness of the rubber layer 112 is the reference thickness $d_0$, and a dotted line in FIG. 8A represents the outer diameter change when the thickness d of the rubber layer 112 is larger than the reference thickness $d_0$. In comparison with two curves, the outer diameter change represented by the dotted line (larger thickness) is less noticeable in the early stage thereof than that represented by the solid line (reference thickness) and thereafter gradually becomes substantially the same as that represented by the solid line. This is because the thickness of the rubber layer 112 becomes larger as an amount of heat transmitted to the pressure roller 140 becomes smaller.

Figure 8C:
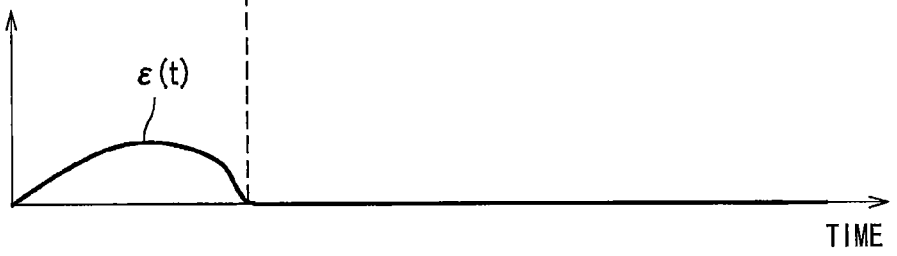
FIG. 8C is a graph illustrating a function $\epsilon(t)$.

Thus, a function $f_4(t)$ for making the conveying speed constant at the thickness d of the rubber layer 112 larger than the reference thickness $d_0$ is represented by a waveform obtained by inverting the dotted waveform of FIG. 8A, i.e., $f_4(t)=f_0(t)+\epsilon(t)\times(d-d_0)$. Here, as illustrated in FIG. 8C, the function $\epsilon(t)$ is such a function that the influence of the thickness error $(d-d_0)$ of the rubber layer 112 is cancelled only in the early stage of the outer diameter change, and specifically the influence of the correction is largest at a peak value in the early stage of the outer diameter change.

Thus, the fifth correction term $+\epsilon(t)\times(d-d_0)$ for the thickness error of the rubber layer 112 is added to the above-described function $N=N_0+f_0(t)$, allowing the influence on the conveying speed due to the thickness error of the rubber layer 112 to be reduced. Specifically, the fifth correction term $+\epsilon(t)\times(d-d_0)$ is a such a correction term that the rotation speed of the motor 500 becomes smaller as the thickness of the rubber layer 112, i.e., the previously measured thickness d, stored in the memory 170 becomes smaller.

<Controller>

Details of the control device 510 will be described below. The control device 510 includes, for example, a CPU (Central Processing Unit), a RAM (Random Access Memory), a ROM (Read Only Memory), and an input/output circuit. The control device 510 performs arithmetic processing based on: inputs from the center thermistor 400C and the side thermistor 400A; content of a print command; and data stored in the memory 170, thereby controlling the motor 500. The temperature detection unit to be used for the following control may be any one of the side thermistor 400A and the center thermistor 400C. However, in the present embodiment, the center thermistor 400C is employed as the temperature detection unit used for the following control.

The control device 510 is configured to perform a reading process for reading from the memory 170 various data such as the outer diameter or data such as the above-described correction terms, an adjustment process for adjusting the rotation speed of the motor 500 based on the read data from the memory 170, and a drive process for driving the motor 500 based on the adjusted rotation speed.

Specifically, the control device 510 adjusts the rotation speed of the motor 500 such that the rotation speed of the motor 500 becomes smaller as the outer diameter of the pressure roller 140 read from the memory 170 becomes larger. This allows the motor 500 to be adequately controlled in accordance with the outer diameter of the pressure roller 140.

Further, the control device 510 adjusts the rotation speed of the motor 500 such that the rotation speed of the motor 500 becomes smaller as the heating capability read from the memory 170 becomes larger. This allows the motor 500 to be adequately controlled in accordance with the outer diameter of the pressure roller 140 that is thermally expanded further as the heating capability of the halogen lamp 120 becomes higher.

Further, the control device 510 adjusts the rotation speed of the motor 500 such that the rotation speed of the motor 500 becomes smaller as the width of the nip portion N read from the memory 170 becomes larger. This allows the motor 500 to be adequately controlled in accordance with the outer diameter of the pressure roller 140 that is thermally expanded further as the width of the nip portion N becomes larger.

Further, the control device 510 adjusts the rotation speed of the motor 500 so as to cancel the overshoot of the outer diameter change of the pressure roller 140 in accordance with the responsiveness read from the memory 170. This allows the motor 500 to be adequately controlled in accordance with the outer diameter change of the pressure roller 140 whose overshoot is increased further as the responsiveness becomes smaller.

Further, the control device 510 adjusts the rotation speed of the motor 500 such that the rotation speed of the motor 500 becomes smaller as the thickness of the rubber layer 112 read from the memory 170 becomes smaller. This allows the motor 500 to be adequately controlled in accordance with the outer diameter of the pressure roller 140 that is thermally expanded further as the thickness of the rubber layer 112 becomes smaller.

Figure 9:
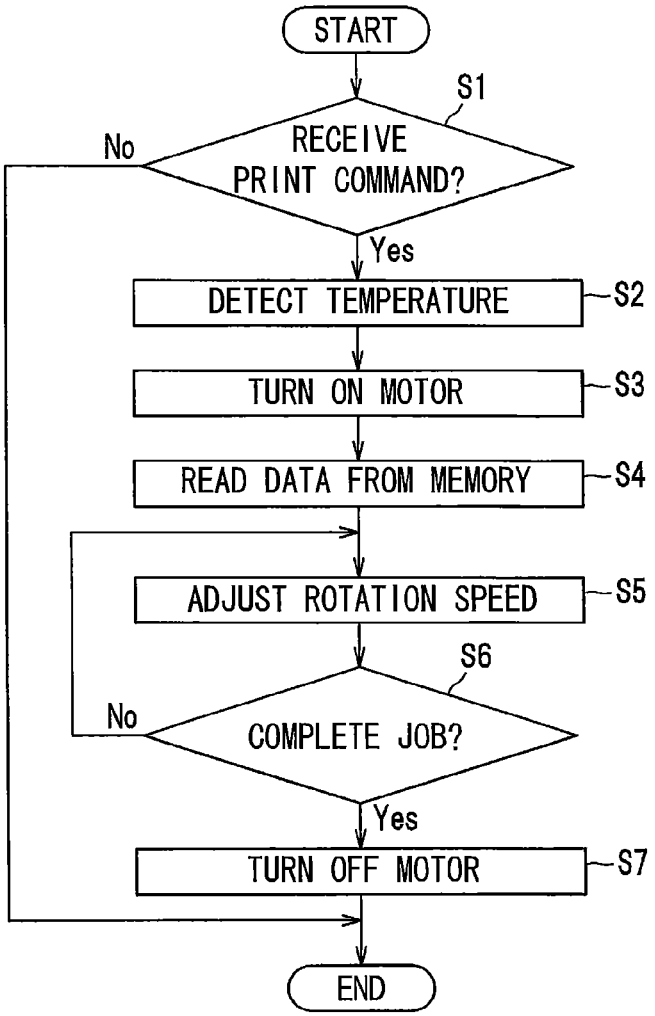
FIG. 9 is a flowchart of an operation of a control device.

Specifically, the control device 510 is configured to constantly perform a flowchart illustrated in FIG. 9.

As illustrated in FIG. 9, the control device 510 determines whether or not a print command is received (S1). If the print command is not received (S1: No), the process is ended. If the print command is received (S1: Yes), the control device 510 acquires the temperature from the center thermistor 400C (S2) and turns on the motor 500 at a predetermined rotation speed (e.g., above-mentioned $N_0$) (S3).

After step S3, the control device 510 reads various data from the memory 170 (S4). More specifically, the control device 510 reads from the memory 170 the data such as the outer diameter of the pressure roller 140, the heating capability of the halogen lamp 120, the width of the nip portion N, the responsiveness of the center thermistor 400C, and the thickness of the rubber layer 112, and the correction expression. When reading the correction expression, the control device 510 selects one from a plurality of the correction expressions based on the temperature detected in step S2 and content of the print command. For example, the control device 510 selects a correction expression having the function $f_0(t)$ illustrated in FIG. 4B in a case where the content of the print command indicates "to perform printing for a predetermined number or more sheets", i.e., continuous printing. Further, for example, the control device 510 selects a correction expression having a function corresponding to the intermittent printing when a plurality of print commands is received after the reception of the print command in step S1.

After step S4, the control device 510 adjusts the rotation speed of the motor 500 based on the read data and the correction expression (S5). After step S5, the control device 510 determines whether or not the job is completed (that is, whether or not the number of print jobs corresponding to the number of print commands is completed) (S6).

In step S6, if the job is not completed (S6: No), the control device 510 returns to step S5. If the job is completed (S6: Yes), the control device 510 turns off the motor 500 (S7) and terminates the process.

According to the present embodiment described above, the following effect can be obtained. The memory 170 storing the outer diameter of the pressure roller 140 is provided in the fixing device 100, allowing the outer diameter of the pressure roller 140 currently provided in the fixing device 100 to coincide with the outer diameter stored in the memory 170 of each fixing device 100. Thus, even when the fixing device 100 is replaced with new one, the motor 500 can be adequately controlled in accordance with the outer diameter of the pressure roller 140 stored in the memory 170.

While the invention has been described in detail with reference to the embodiment thereof, it would be apparent to those skilled in the art that various changes and modifications may be made therein without departing from the spirit of the invention.

In the above embodiment, the rotation speed of the motor 500 is adjusted using the correction expression. However, the present invention is not limited to this configuration. A table representing a relationship between the data and motor rotation speed may be used to adjust the motor rotation speed. Further, not all the data mentioned in the above embodiment is required to be stored in the memory, and at least the outer diameter of the pressure roller needs to be stored.

In the above embodiment, the memory 170 stores as a constant value the outer diameter D, the heating capability W, the width D of the nip portion N, the responsiveness of the center thermistor 400C, and the thickness d of the rubber layer 112. However, the present invention is not limited to this configuration. The data mentioned above may be corrected in accordance with duration of use, taking the change of data with time into consideration.

In the above embodiment, the heating member H including the fusing belt 110, the halogen lamp 120, and the like is employed. However, the present invention is not limited to this configuration. The heating member employed in the present invention may be constituted by, e.g., a cylindrical heating roller and a halogen lamp provided inside the heating roller.

In the above embodiment, the center thermistor 400C is employed as the temperature detection unit. However, the present invention is not limited to this configuration. The side thermistor 400A may be employed as the temperature detection unit.

In the above embodiment, the present invention is applied to the color laser printer 1. However, the present invention may be applied to other image forming apparatuses, such as a copier or a multifunction machine.

What is claimed is:

1. An image forming apparatus comprising:

a fixing device comprising:

a heating member;

a drive roller in contact with the heating member at a nip portion therebetween; and a memory configured to store an outer diameter of the drive roller and a heat capability of the heating member;

a motor configured to drive the drive roller; and a control device configured to:

read the outer diameter and the heating capability from the memory;

adjust a rotation speed of the motor such that the rotation speed of the motor becomes smaller as the outer diameter read from the memory becomes larger and such that the rotation speed becomes smaller as the heating capability read from the memory becomes larger; and drive the motor at an adjusted rotation speed.

2. The image forming apparatus according to claim 1, wherein the outer diameter includes a first outer diameter which is a previously measured outer diameter of the drive roller and a second outer diameter which is a reference outer diameter of the drive roller, and wherein the control device is configured to adjust the rotation speed of the motor based on a difference between the first outer diameter and the second outer diameter.

3. The image forming apparatus according to claim 1, wherein the memory is further configured to store a width of the nip portion in an axial direction of the heating member, and wherein the control device is further configured to:

read the width of the nip portion from the memory; and adjust the rotation speed of the motor such that the rotation speed of the motor becomes smaller as the width of the nip portion read from the memory becomes larger.

4. The image forming apparatus according to claim 1, wherein the fixing device further comprises a temperature detection unit configured to detect a temperature of the heating member, wherein the memory is further configured to store a responsiveness of the temperature detection unit, the outer diameter including a first outer diameter as a reference outer diameter and a second outer diameter offset from the first outer diameter depending on the responsiveness of the temperature detection unit, and wherein the control device is further configured to:

read the responsiveness of the temperature detection unit from the memory; and adjust the rotation speed of the motor such that the offset of the second outer diameter is cancelled.

5. The image forming apparatus according to claim 1, wherein the heating member comprises a belt having a rubber layer, wherein the memory is further configured to store a thickness of the rubber layer of the belt, and wherein the control device is further configured to:

read the thickness of the rubber layer from the memory; and adjust the rotation speed of the motor such that the rotation speed becomes smaller as the thickness of the rubber layer read from the memory becomes thinner.

6. An image forming apparatus comprising:

a fixing device comprising:

a heating member;

a drive roller in contact with the heating member at a nip portion therebetween; and a memory configured to store an outer diameter of the drive roller and a width of the nip portion in an axial direction of the heating member;

a motor configured to drive the drive roller; and a control device configured to:

read the outer diameter and the width of the nip portion from the memory;

adjust a rotation speed of the motor such that the rotation speed of the motor becomes smaller as the outer diameter read from the memory becomes larger and such that the rotation speed of the motor becomes smaller as the width of the nip portion read from the memory becomes larger; and drive the motor at an adjusted rotation speed.

7. The image forming apparatus according to claim 6, wherein the outer diameter includes a first outer diameter which is a previously measured outer diameter of the drive roller and a second outer diameter which is a reference outer diameter of the drive roller, and wherein the control device is configured to adjust the rotation speed of the motor based on a difference between the first outer diameter and the second outer diameter.

8. The image forming apparatus according to claim 6, wherein the fixing device further comprises a temperature detection unit configured to detect a temperature of the heating member, wherein the memory is further configured to store a responsiveness of the temperature detection unit, the outer diameter including a first outer diameter as a reference outer diameter and a second outer diameter offset from the first outer diameter depending on the responsiveness of the temperature detection unit, and wherein the control device is further configured to:

read the responsiveness of the temperature detection unit from the memory; and adjust the rotation speed of the motor such that the offset of the second outer diameter is cancelled.

9. The image forming apparatus according to claim 6, wherein the heating member comprises a belt having a rubber layer, wherein the memory is further configured to store a thickness of the rubber layer of the belt, and wherein the control device is further configured to:

read the thickness of the rubber layer from the memory; and adjust the rotation speed of the motor such that the rotation speed becomes smaller as the thickness of the rubber layer read from the memory becomes thinner.

10. An image forming apparatus comprising:

a fixing device comprising:

a heating member;

a drive roller in contact with the heating member at a nip portion therebetween;

a temperature detection unit configured to detect a temperature of the heating member; and a memory configured to store an outer diameter of the drive roller and a responsiveness of the temperature detection unit, wherein the outer diameter includes a first outer diameter as a reference outer diameter and a second outer diameter offset from the first outer diameter depending on the responsiveness of the temperature detection unit;

a motor configured to drive the drive roller; and a control device configured to:

read the outer diameter and the responsiveness of the temperature detection unit from the memory;

adjust a rotation speed of the motor such that the rotation speed of the motor becomes smaller as the outer diameter read from the memory becomes larger and such that the offset of the second outer diameter is cancelled; and drive the motor at an adjusted rotation speed.

11. The image forming apparatus according to claim 10, wherein the second outer diameter is a previously measured outer diameter of the drive roller.

12. The image forming apparatus according to claim 10, wherein the heating member comprises a belt having a rubber layer, wherein the memory is further configured to store a thickness of the rubber layer of the belt, and wherein the control device is further configured to:

read the thickness of the rubber layer from the memory; and adjust the rotation speed of the motor such that the rotation speed becomes smaller as the thickness of the rubber layer read from the memory becomes thinner.

* * * * *